US005428938A

United States Patent [19]

Davis

[11] Patent Number: 5,428,938

[45] Date of Patent: Jul. 4, 1995

[54] METHOD OF LOADING PRODUCT INTO A CONTAINED BAG

[76] Inventor: Robert Davis, 7305 Woodbine Avenue, Unit #519, Markham, Ontario, Canada, L3R 3V7

[21] Appl. No.: 204,918

[22] Filed: Mar. 2, 1994

[51] Int. Cl.[6] ..... B65B 11/58; B65B 1/00

[52] U.S. Cl. ..... 53/284.7; 53/175; 53/260; 53/385.1; 53/449; 53/570

[58] Field of Search ..... 53/175, 284.7, 284.5, 53/260, 449, 385.1, 570, 571

[56] References Cited

U.S. PATENT DOCUMENTS

| | | | |
|---|---|---|---|
| 3,314,210 | 4/1967 | Jarund | 53/175 |
| 3,478,490 | 11/1969 | Sylvester et al. | 53/385.1 |
| 3,698,153 | 10/1972 | Lieberman | 53/260 |
| 3,727,374 | 4/1973 | Williams | 53/385.1 |
| 4,142,453 | 3/1979 | Gidewall et al. | 53/175 |
| 4,245,453 | 1/1981 | Altenophl et al. | 53/385.1 |
| 4,510,737 | 4/1985 | Ellert | 53/570 |
| 4,687,462 | 8/1987 | Rewitzer | 53/175 |
| 5,029,431 | 7/1991 | Weening et al. | 53/449 |
| 5,100,370 | 3/1992 | Barbour | 53/175 |

*Primary Examiner*—W. Donald Bray

[57] ABSTRACT

A method of loading product into a soft bag held within a rigid case comprises loading the case onto a vertically movable case support in a direct path beneath a chute to which the product is fed. The bag is opened while it is held between the chute and the case with the case spaced below the bag. The case is then raised to meet the bag from below after the bag is opened and the open bag is then pushed into the case. From there, the bag is loaded with the product which is dropped from the chute into the bag.

7 Claims, 9 Drawing Sheets

METHOD OF LOADING PRODUCT INTO A CONTAINED BAG

FIELD OF THE INVENTION

The present invention relates to a method and apparatus of loading product into a soft bag confined within a rigid case.

BACKGROUND OF THE INVENTION

Recently, developments have been made regarding small sized milk containers. In the past individual milk servings have been in the form of small cardboard milk cartons which are tremendously popular in school cafeterias and the like. However, these cartons form a very bulk waste product with associated space requirements.

In view of the above waste problems, the small individual serving milk cartons have been replaced by plastic pouches which are easily opened by punching a straw through the pouch. The empty pouch requires very little in the way of waste storage space.

As will be appreciated, these pouches must be bulk packaged and the preferred method of packaging is through the use of a much larger plastic bag. However, because of the soft nature of the bag, it is more easily filled when it is trapped within a rigid case with the case then providing support for the bag as it is being loaded.

Current techniques for loading products such as small milk pouches and the like into soft containment bags are either very labour intensive or rely upon complicated machinery which is subject to frequent failure and/or improper feed of the pouches into the bags. To the Applicant's knowledge, there is nothing currently available in the way of a simple efficient loading apparatus for loading products such as small milk pouches into a soft containment bag for the pouches.

SUMMARY OF THE INVENTION

The present invention provides a method and apparatus for loading products such as small milk pouches and the like into a soft bag held within a rigid case. The method comprises loading the case onto a vertically movable case support in a direct path beneath a chute to which the product is fed. The bag is opened while it is held between the chute and the case with the case spaced below the bag. After the bag is opened, the case is raised to meet the bag from below at which point, the open bag is pushed into the case and loaded with the product dropped from the chute into the bag.

The apparatus for carrying out the method uses reliable bag handling components such as a gravity operated chute and a bag wicket with mechanically and pneumatically operated opening of the bag from the wicket, the operation of which has proved successful in other bag handling products. These components therefore have known reliability. In addition, a simple yet extremely reliable mechanical case lifting support is provided in co-operation with the chute and the bag opening operations resulting in a extremely reliable device for loading the product into the bag.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
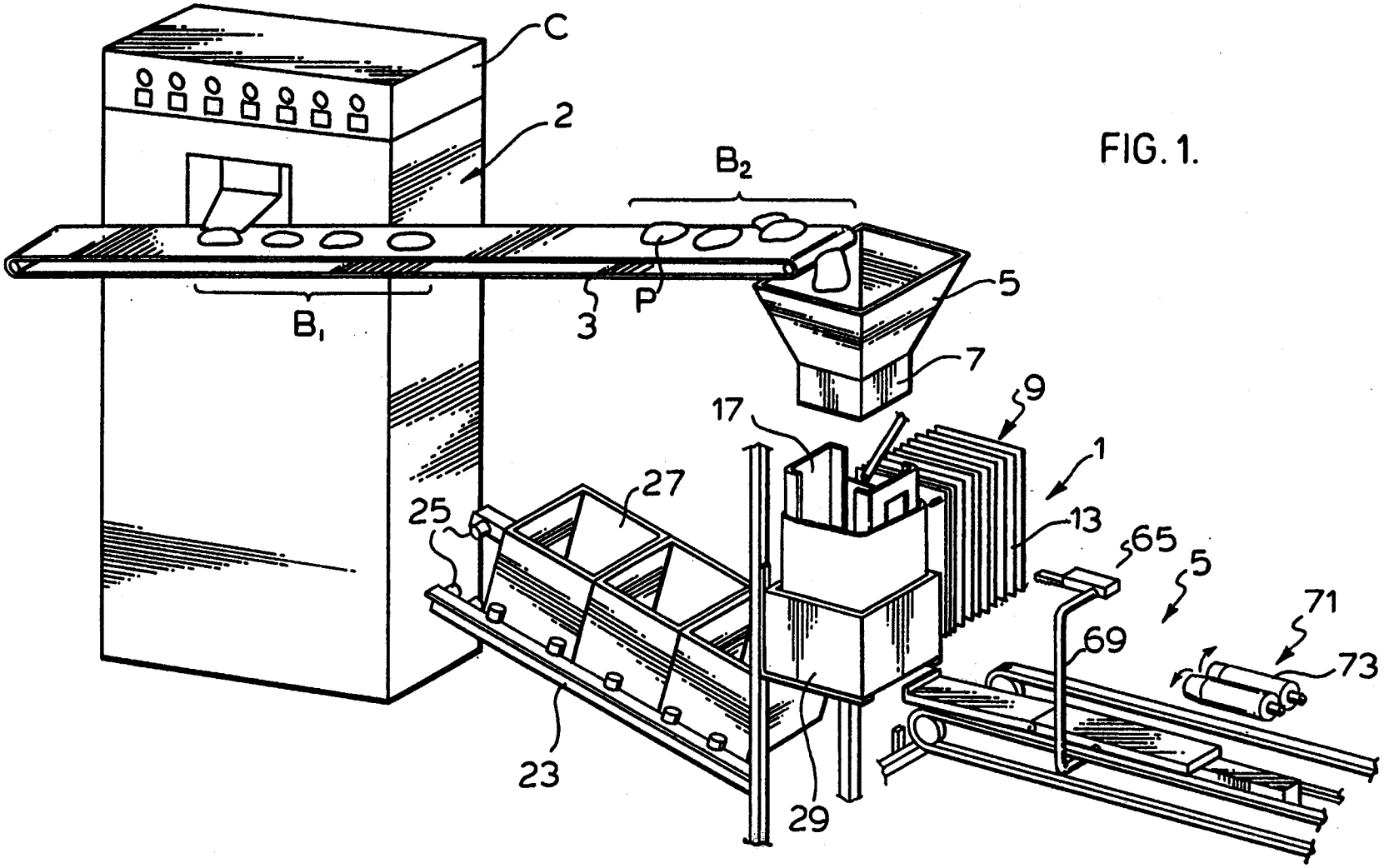
FIG. 1 is a perspective view of an overall product loading apparatus according to a preferred embodiment of the present invention.
Figure 1A:
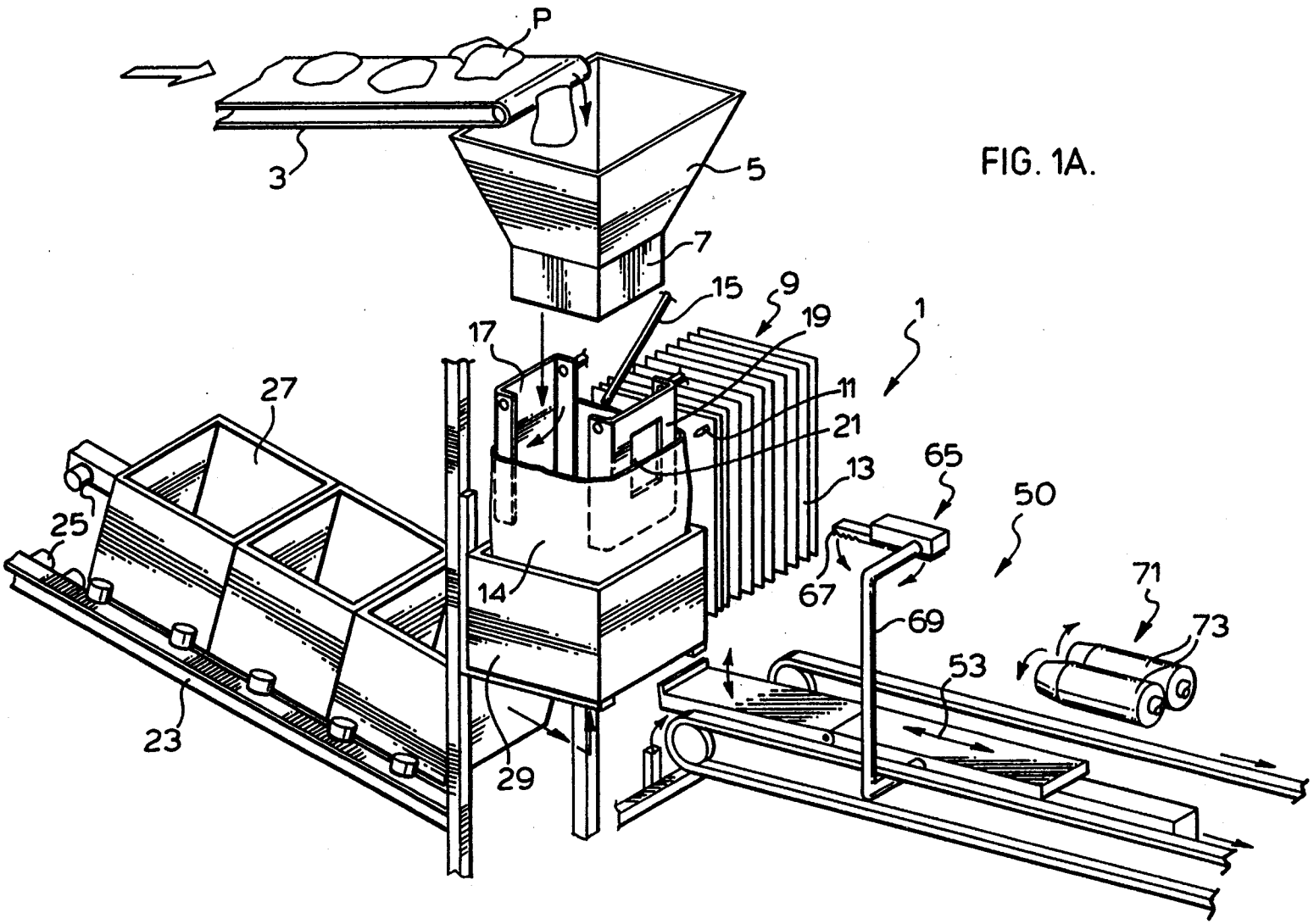
FIG. 1A is an enlarged perspective view of one area of the product loading apparatus of FIG. 1.

FIGS. 1 and 1A show a bag loading apparatus generally indicated at 1. This apparatus is controlled by controller C to operate various different components of the apparatus in appropriately timed fashion as will be described later in detail. The apparatus includes a conveyor belt 3 feeding product P to a chute 5. The product is loaded onto the conveyor belt from a master product container 2 with indexing means to provide the product in batches such as latches B1 and B2 of a preset number of product. By way of example only, the product may comprise individual milk pouches which are loaded in groups of 50 onto conveyor 3. The 50 pouches will be dispersed lengthwise along the conveyor belt at which point there will be an interruption of the product with the conveyor belt still continuing to move and then a further 50 milk pouches may be deposited from the master container onto the conveyor belt.

Chute 5 has a large upper end providing a large surface area into which to deposit the product P. The chute then tapers downwardly to its lower end 7 which because of its decreased size provides much more guided dropping of the product from the chute.

Located beneath the chute is a bag holder generally indicated at 9. This bag holder comprises a bag wicket formed by a pair of wicket arms 11, only one of which can be seen in FIG. 1. A plurality of folded plastic bags 13 are held flatly side by side with one another on the bag wicket.

A nozzle 15 which is fed with air pressure from a source not shown, points down at the outermost bag on the bag wicket. A pair of pivotal flaps 17 and 19 are mounted to the apparatus in the area to which nozzle 15 is directed.

A rigid case handling system is provided along the bottom side of the loading apparatus. This system includes a downwardly sloped case track 23 fitted with rollers 25 on which a series of rigid cases are fitted. Because of the slope and rollers on track 23, the cases under their own weight slide forwardly within the product loading apparatus.

A specific movable case support generally indicated at 35 is provided in a direct path beneath the chute 5. Case support 35 includes mounting arms 37 slideably secured on vertical frame parts 31 of the apparatus. A chain 33 operated by a chain drive which is not shown, is secured to cross post 39 of the case support.

The case support further includes angled track sections 41 having rollers 43. These track sections line up with track 23 so that the cases slide one by one onto case support 35. A vertically movable stop 49 is provided at the downstream end of track 23 before the case support as shown for example in FIG. 3 of the drawings to ensure that the cases slide one by one onto the case support. Stop 49 is controlled by a timing circuit to move up to the FIG. 3 position as soon as a case has passed over the stop. The stop will only move down to a release position no allow a second case to move onto the case support after the first case has been loaded with product and moved forwardly off of the case support as to be described later in detail.

Case support 35 further includes horizontal platform sections 45 dropped slightly below the rollers 43 on track sections 41. The main base frame of the apparatus includes a stop 47 which determines the maximum forward movement of the case onto the case support. The length of platform sections 45 to either side of the case support is very close to the length of the actual case itself and the case by virtue of being trapped between rollers 43 and stop 47 is very accurately positioned on the case support.

Figure 2:
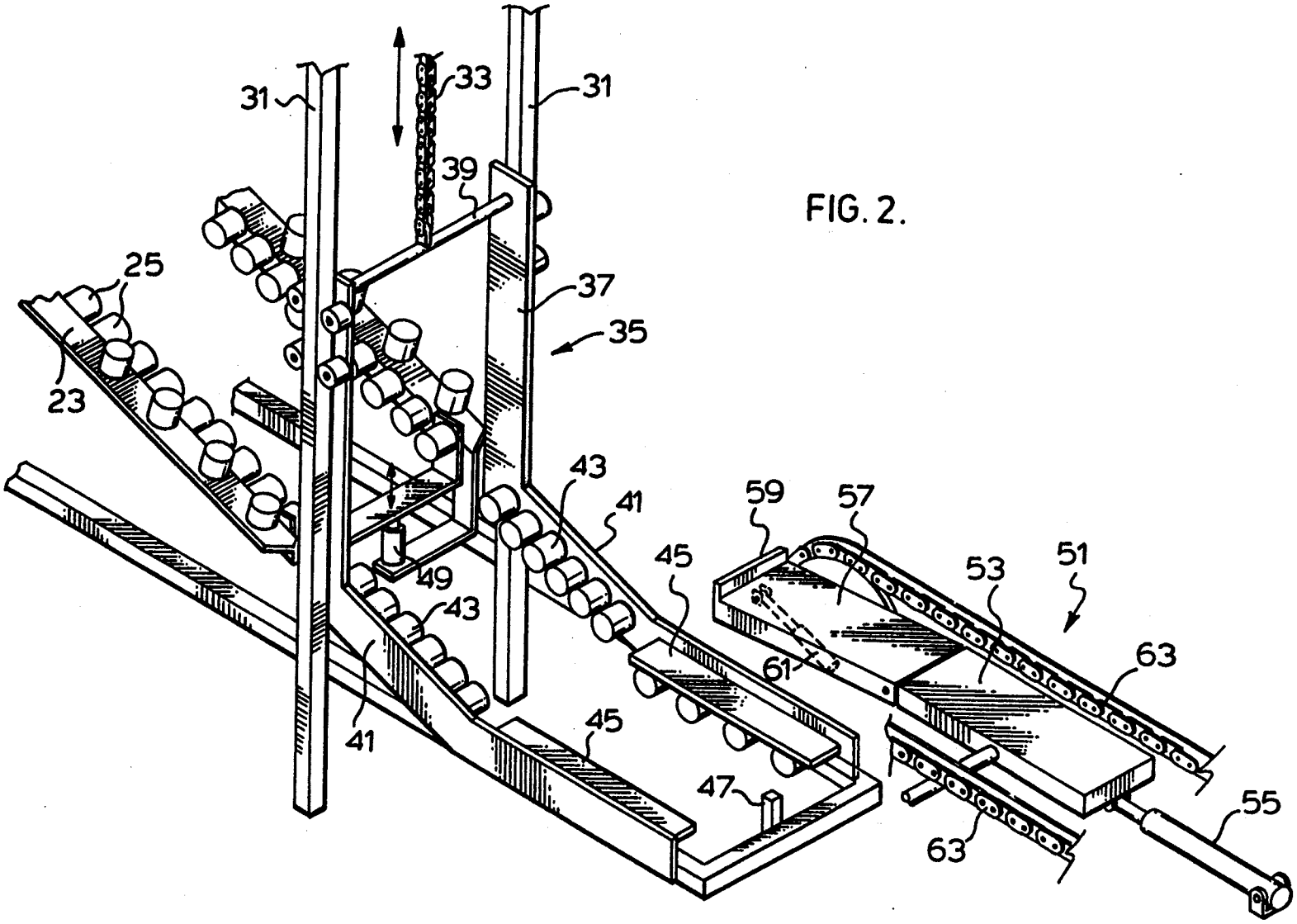
FIG. 2 is an enlarged perspective view of the movable case support of the apparatus of FIG. 1.

Located forwardly of the case support is a case puller generally indicated at 51 seen in FIG. 2 of the drawings. This case puller comprises a pair of support plates 53 and 57 which are hingedly connected to one another. The case puller is movable axially of the apparatus by means of a piston control 55.

Support plate 57 is tiltable relative to the support plate 53 and its motion is controlled by means of a piston 61. Provided at the upstream end of plate 57 is a raised puller tongue 59.

The puller plate assembly is movable between conveyor chains 63 which operate to move cases downwardly away from the product loading apparatus as will be described later in detail.

Figure 3:
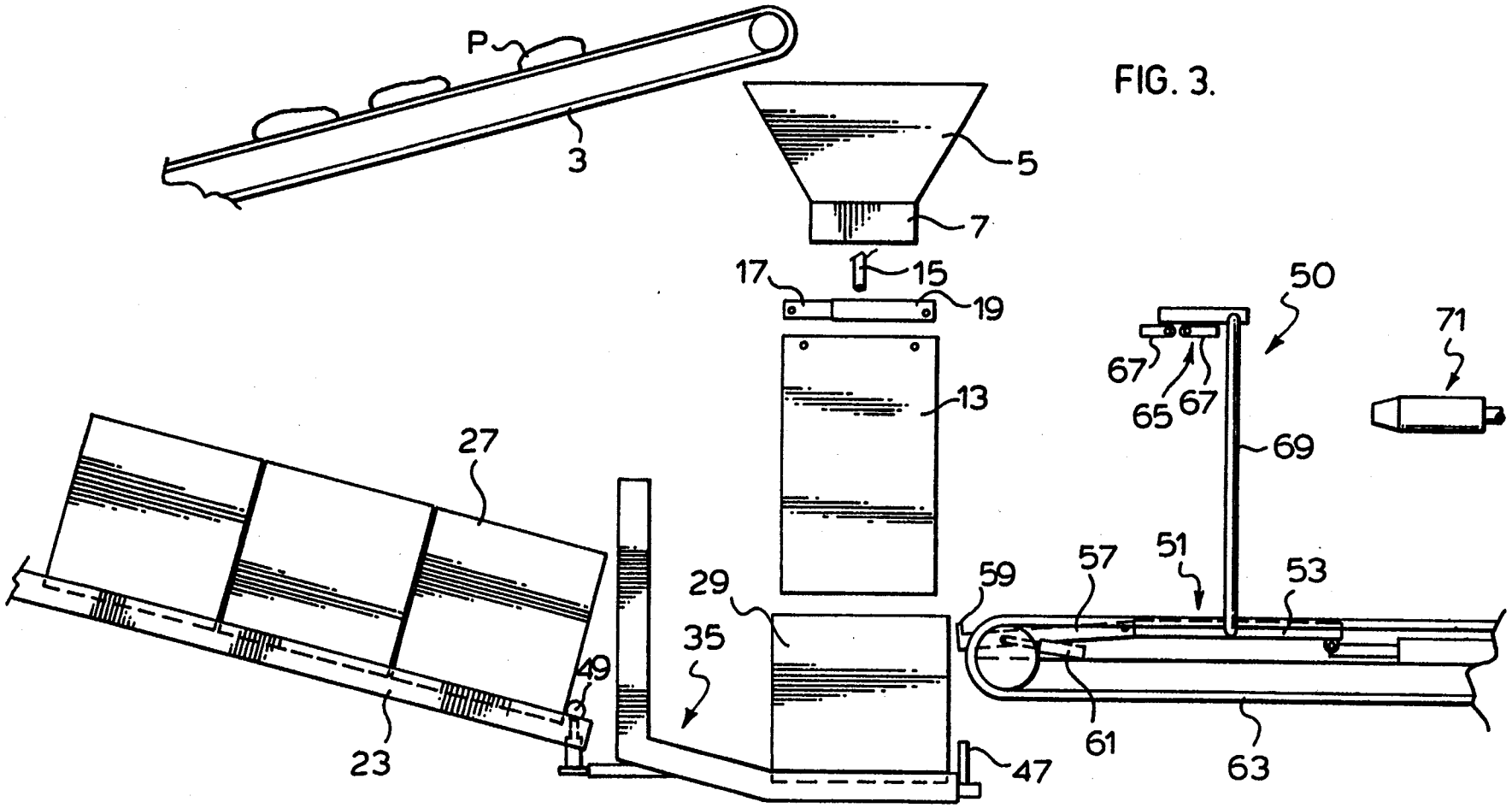
FIGS. 3 through 7 are side views of the bag loading apparatus of FIG. 1 showing the different sequence of steps involved in loading of the product into the bag.
Figure 4:
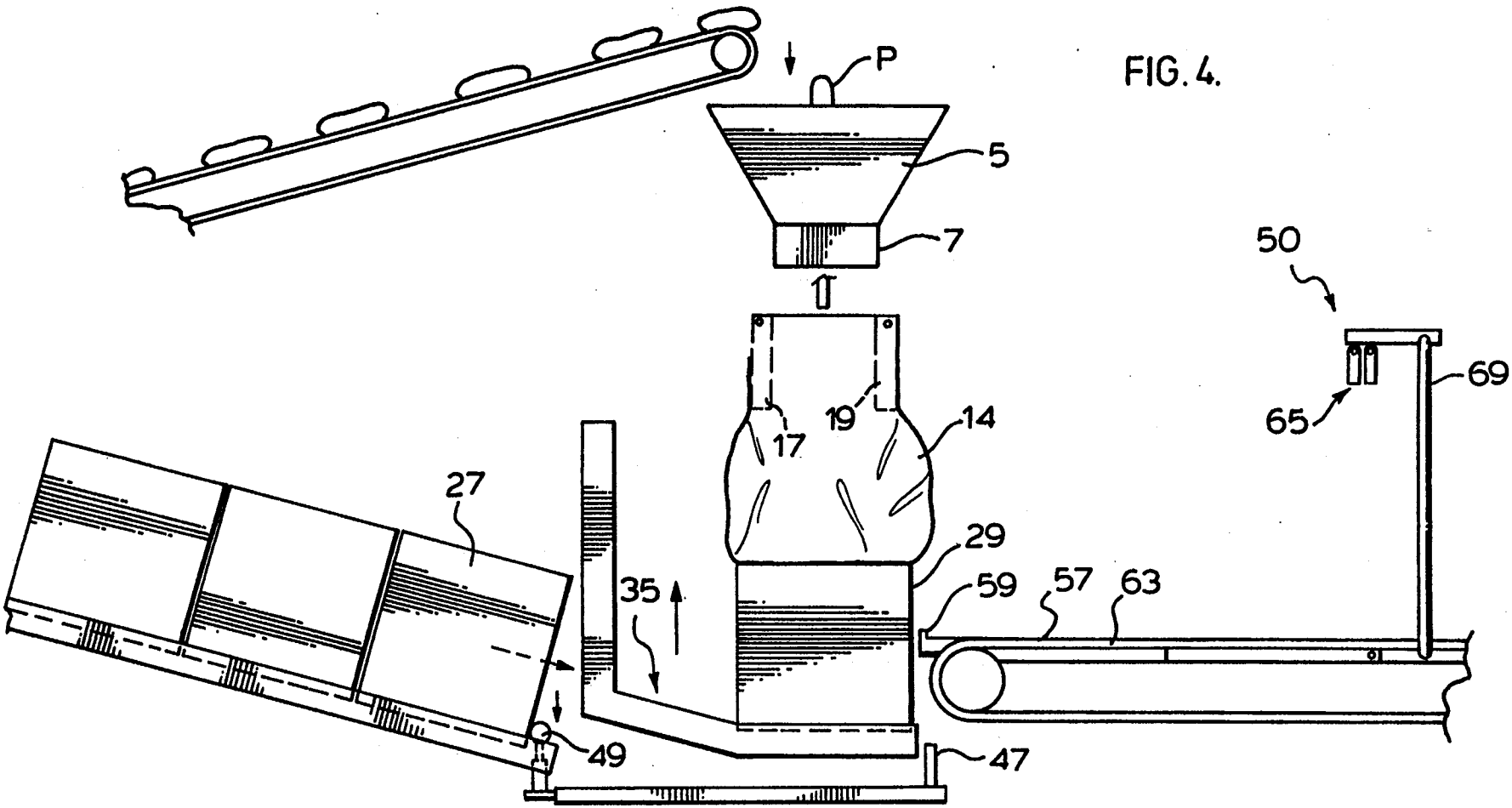

The puller plate assembly is part of an overall downstream handling system generally indicated at 50 as seen for example in FIGS. 3 and 4 of the drawings. In addition to the case puller assembly described above, the handling system includes a bag gripper 65 comprising a pair of movable grip fingers 67 mounted on upright support 69. Further downstream of the bag gripper is a brushing assembly 71 comprising a pair of rotatable brushes 73 used for closing the top of a filled bag which can then be sent to a bag closure system which is not shown.

The bag loading apparatus operates as follows. As earlier described, product is loaded in an indexed manner onto conveyor 3. The conveyor delivers the product to chute 5. Before the product reaches the chute, a bag supported at bag wicket 9 is initially blown open by a stream of air provided through nozzle 15. As the bag mouth begins to open beneath bag flaps 17 and 19, these two flaps open downwardly from the FIG. 3 to the FIG. 4 position to grip the inside surface of the bag. The flaps additionally provide a product loading guide.

As earlier described, a rigid case loaded onto the platform shelves 45 of the case support is located in a direct path beneath chute 5. The desired positioning for the case is one in which its center is located beneath the center of the chute. As seen in FIGS. 1 and 1A of the drawings, the bags, when in their folded hanging position as indicated at 13 are located off to one side of the drop path beneath the chute. The bag is not centered beneath the chute until it is opened as indicated by bag 14. The case 29 loaded on the case support would interfere with the opening of bag 14 if the case was not located below the bag as it is being opened and therefore, during the bag opening, case support 35 is in its lowermost position as shown for example in FIGS. 2 and 3 of the drawings.

Almost simultaneously with the opening of the bag, case support 35 is drawn upwardly by means of chain 33 so that the case meets with the bottom of the bag as shown in FIG. 4 of the drawings. The bag however is billowed out by the air pressure and because the bag is preferably oversized relative to the interior dimensions of the case, the bottom of the bag sits approximately level with the top of the case with some bag overhang around the upper edge of the case. The bag to this point does not go down to any extent into the case. Even as the case rises to its maximum height as shown for example in FIG. 5 of the drawings, the bag would not tend to move into the case unless it is physically pushed to that position. This can be accomplished in one of a number of different manners.

Figure 5:
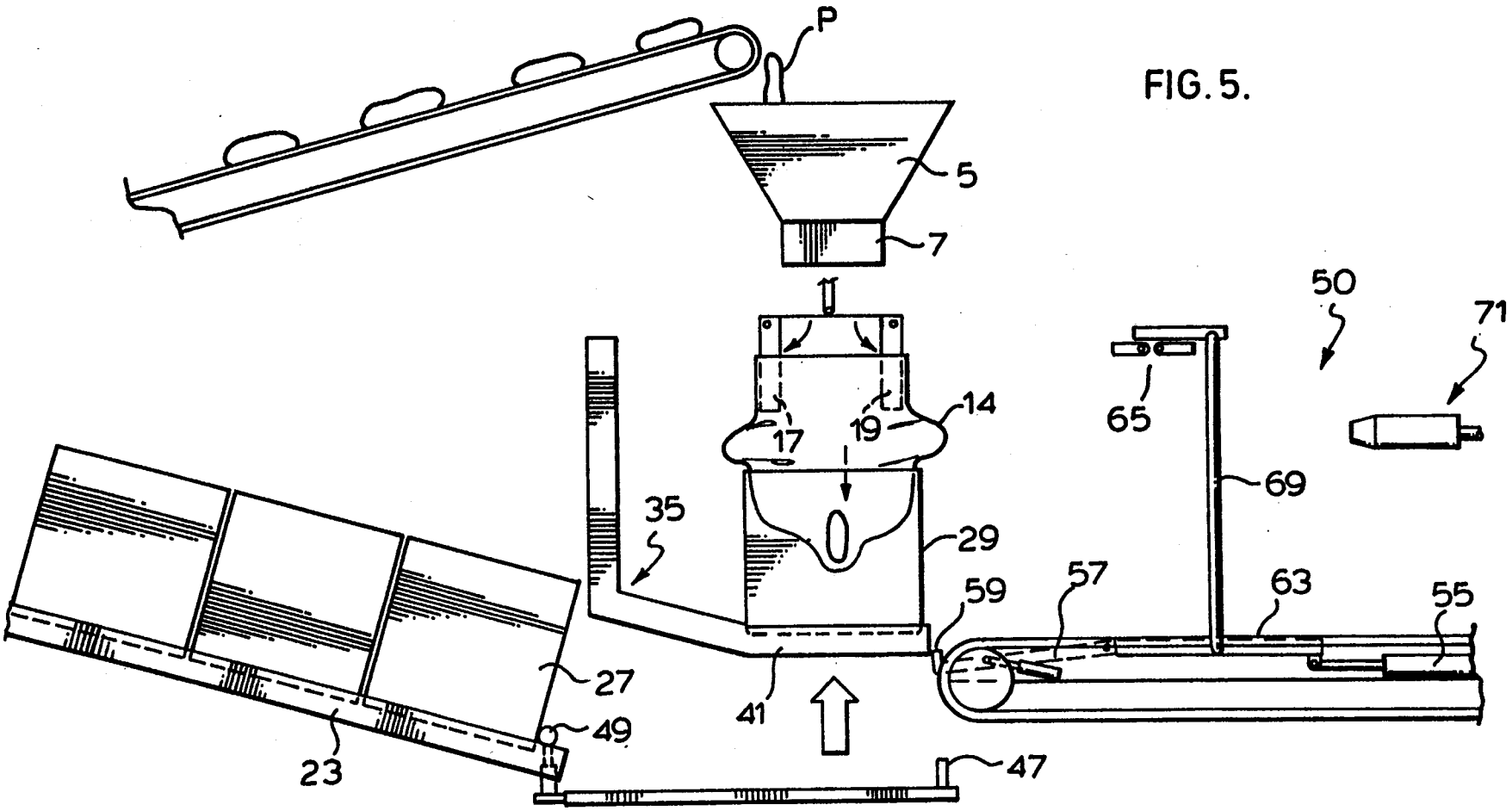
Figure 6:
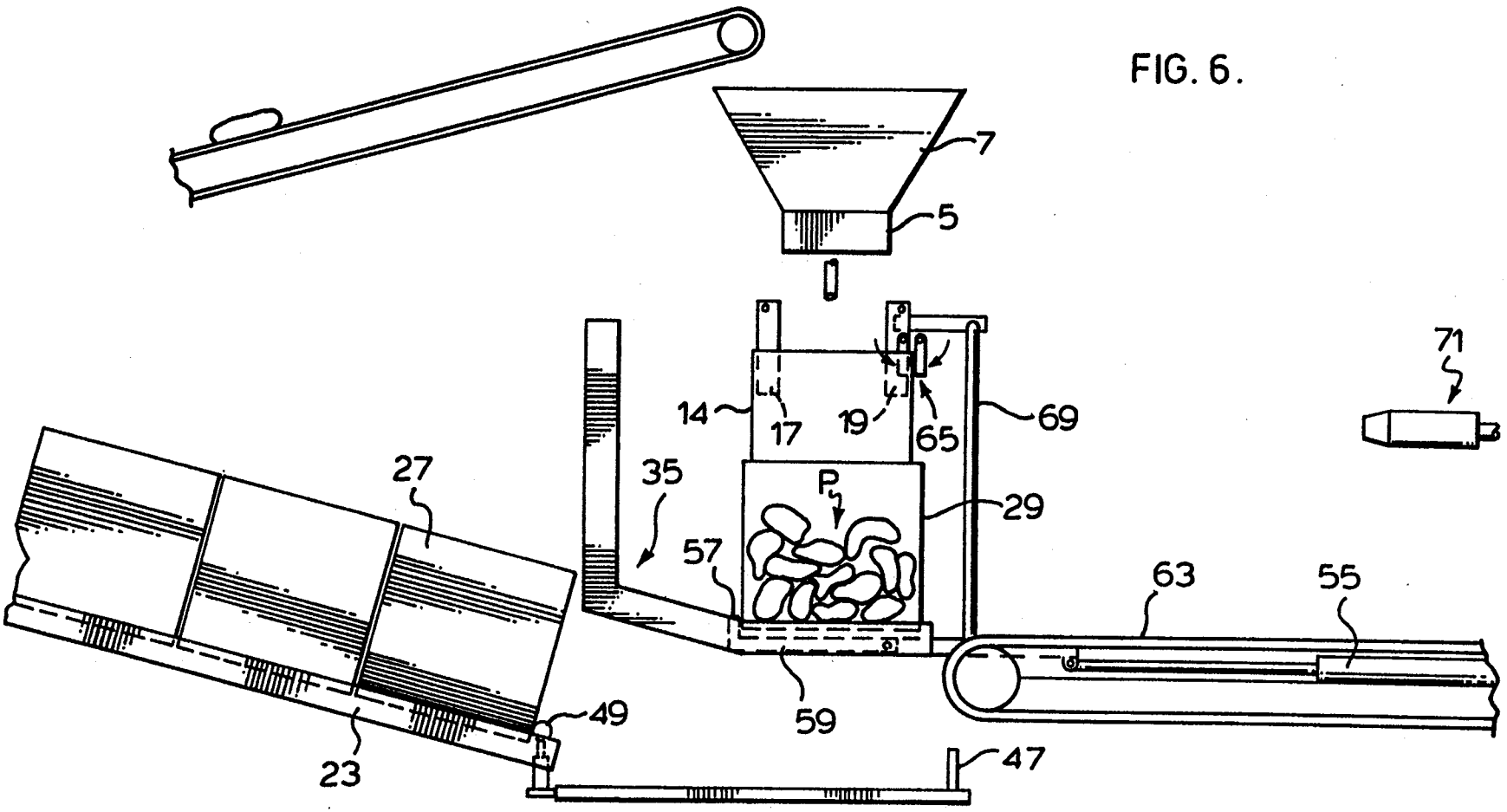

As earlier described, the product P is loaded onto conveyor 3 in batches in a timed fashion. Accordingly, and as earlier noted, the product P does not reach the chute 5 until the bag has been opened and the case brought up to the bottom of the open bag. At this point, the product P does feed to the chute as shown in FIG. 5 of the drawings and it is the weight of the product dropping down into bag 14 which then pushes the bottom of the bag into the case. When the apparatus is properly set up, the lower end 7 of chute 5 is positioned centrally over the mouth of bag 14 and the case 29 is centered beneath the chute mouth. With this set up, the first few products which are dropped from the chute drop into the center of the bag which causes the bag to be pulled evenly down into the case. The bag then effectively forms an interior liner within the case. As shown in FIG. 6 of the drawings, the product will continue to drop from the chute until the bag is filled to the extent desired at which point, the batch of product ends and the feed to the chute is interrupted.

FIG. 6 shows the bag after it has been appropriately filled with product and still positioned beneath the chute. Here it will be seen that case support 35 has been lifted to a position where case 29 is level with the upper surface of conveying chains 63 in the downstream case handling system 50. Note that the carton stop 47 is provided on the main frame of the bag loading apparatus and does not move up with the case support. Therefore, the case is free to move downstream of the case support when elevated to the FIG. 6 position. At this point, the case puller assembly 51 best shown in FIG. 2 of the drawings is set in motion. The two plates 53 and 57 are pushed by piston 55 upstream at the case. Plate 57 is tipped downwardly by piston 61 such that the puller tongue 59 slides beneath the case between platforms 45 of the case support to the upstream end of the case. At this point, piston 61 operates to raise plate 57 and the puller tongue 59 engages the upstream bottom edge of the case.

At the same time, bag gripper 65 on support 69 is moved over towards the mechanical bag opener and gripper finger 67 is pushed while it extends horizontally through opening 21 in flap 19. The two gripper fingers then move downwardly to grip on either side of the filled bag edge.

Figure 7:
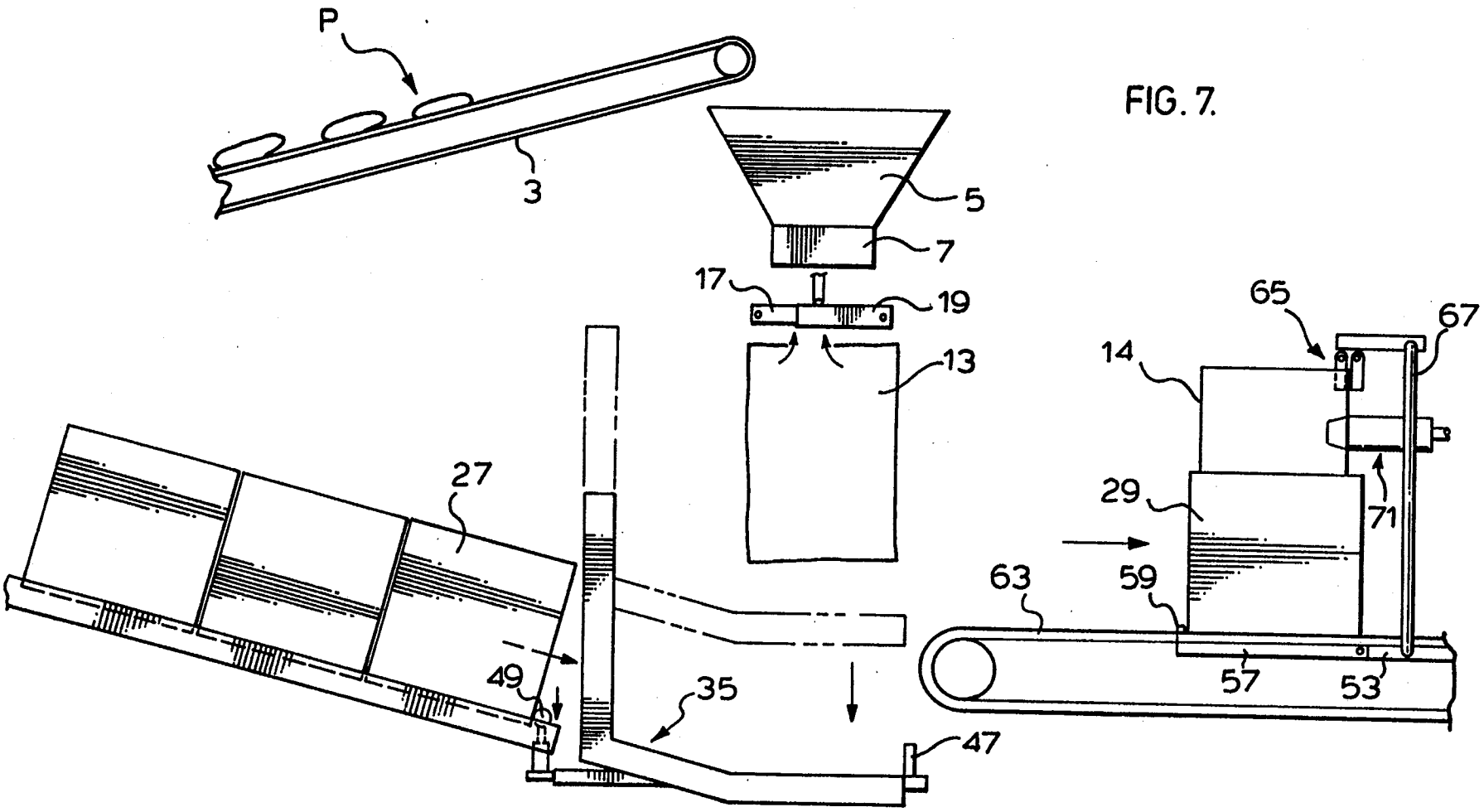

Once the gripper 65 is in position and with the case pulling assembly engaging the bottom side of the case, flaps 17 and 19 are drawn upwardly out of the bag and the bag puller is drawn downstream by piston 55 pulling the case and loaded bag with it. Once the case has been seated on the plates 57 and 53 and drawn over to the conveyor chains 63, case support 35 is released to move back down to its case loading position as shown in FIG. 7 of the drawings. At the same time, case 29 with loaded bag 14 is moved along the downstream case handling system so that the upper edges of the bag held upwardly by the bag gripper are fed to the bite between the two brushes 73 which effectively close the top of the bag from which point it is fed to a bag closure device as noted above. This bag closure device preferably applies a QWIK LOK TM reusable bag closure as is known to those skilled in the art. The upper edge of the bag is released by the bag gripper either before or during application of the bag closure so that the bag contained within the rigid case is now ready for further handling as desired.

As also shown in FIG. 7, while the case support 35 is being moved back down to its case loading position, the empty cases 27 are held in their ready to load condition by means by movable stop 49. As soon as the case support reaches its lowermost position, stop 49 will release the next case which will then ride down onto the case support as earlier described.

As also seen in FIG. 7 of the drawings, the next batch of product moving forwardly on conveyor 3 has not yet reached chute 5 and is timed such that it will only reach he chute after the next bag has been opened and the next case has been lifted up directly beneath the open bag. At that point, the bag loading and downstream handling operation will once again be performed in the identical manner to that described above.

Figure 8:
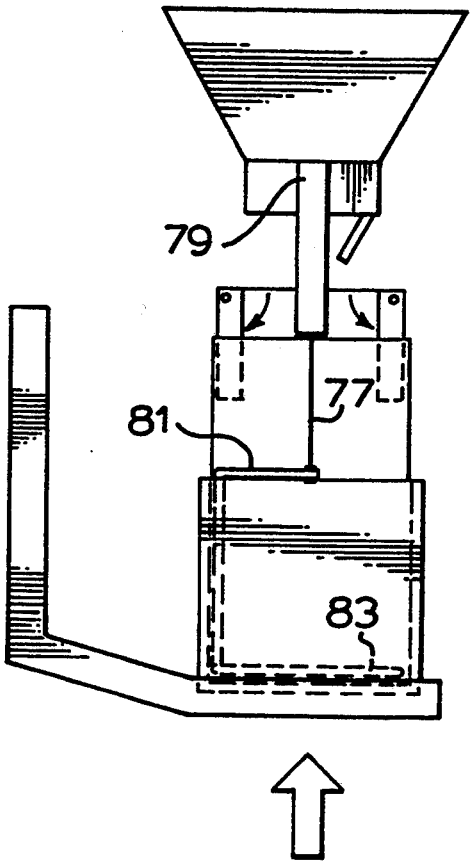
FIG. 8 is a sectional view of a bag being pushed into a case according to a preferred embodiment of the present invention.

As earlier noted, there are different ways of loading the open empty bag into the case. One of those methods is by pushing the bag downwardly into the case by the weight of the product fed into the bag. FIG. 8 of the drawings shows an alternate bag pushing arrangement to force the bag into the case.

As with the earlier described method, the bag is first opened by a combination of pneumatic pressure and flap guides and the case is lifted up to meet with the bottom of the open bag. From here, a pusher mechanism generally indicated at 75 is operated to push on the bag bottom. This pusher mechanism comprises a cylinder 79 supported to the apparatus with a downwardly directed piston arm 77. Secured to piston arm 77 is a support arm 81 with an enlarged loop 83 at the lower end of arm 81.

The positioning of pusher mechanism 75 is such that loop 83 is positioned directly above the case interiorly of to the open but not yet filled bag and as the piston arm 77 is pushed downwardly out of the cylinder 79, loop 83 moved by arm 81 is pushed downwardly into the bag to force the lower end of the bag into the case.

Figure 9:
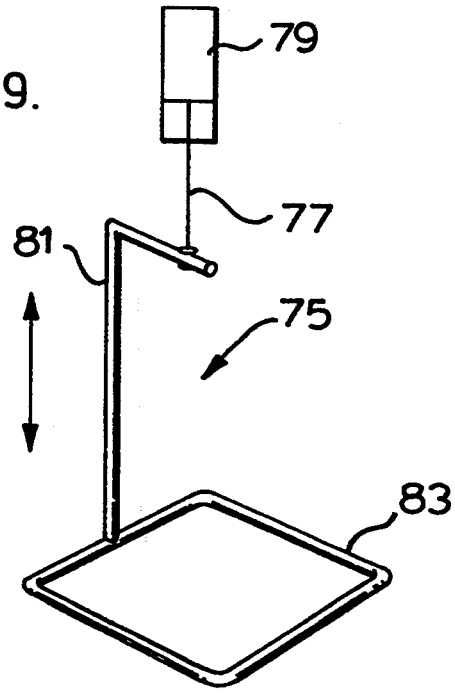
FIG. 9 is a perspective view of the pushing tool used to push the bag into the case of FIG. 8.

As can be seen in FIG. 9 of the drawings, arm 81 is laterally off-set from the operating piston so that the piston itself is not in the drop path area to the bag. In the embodiment both the arm 81 and loop 83 are formed with rounded contours so that as soon as the loop pushes the bag down into the case, the product is timed to fall into the bag. The arm and loop are then pulled upwardly out of the bag even as the product continues to fall but the product will not catch on the arm or the loop which allows them both to be withdrawn from the bag as the bag loading is continued.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. Apparatus for loading a soft bag into a rigid case and for loading product into the bag held in the rigid case, said apparatus comprising a vertically movable case support on which the case is seated, a gravity operated chute above said case support with a straight line feed path from said chute to said case support, a conveyor which conveys the product to said chute, a holder which holds closed bags above said case support, below said chute and laterally displaced from said straight line feed path, bag opening means which opens the bag into the straight line feed path between the chute and the case support, a case support lifter and timed control means which first operates said bag opening means and then operates said case lifter to vertically raise the case to meet with the bag from below.

2. Apparatus as claimed in claim 1 wherein said bag opening means comprises in combination an air fed nozzle and a pair of moveable flaps.

3. Apparatus as claimed in claim 1 including a bag pusher which pushes the bag downwardly into the case.

4. Apparatus as claimed in claim 1 including a case conveyor and a case puller which pulls the case from said case support onto said case conveyor.

5. Apparatus as claimed in claim 4 wherein said case support comprises a pair of spaced apart support members and said case puller comprises a pivotal plate with a raised lip at an end thereof which moves between said support members to pull the case from said case support.

6. Apparatus as claimed in claim 1 including a case loading track which loads cases to said case support and a movable case stop which is controlled by said timed control means to load cases one by one onto said case support.

7. Apparatus as claimed in claim 5 including a bag gripper which grips the bag as said case puller pulls the case from said case support onto said case conveyor.

* * * * *